US010689895B2

(12) United States Patent
Lamoureux

(10) Patent No.: US 10,689,895 B2
(45) Date of Patent: Jun. 23, 2020

(54) DEVICE FOR ADJUSTING THE ELEVATION OF A PIECE

(71) Applicant: A. RAYMOND ET CIE, Grenoble (FR)

(72) Inventor: David Lamoureux, Grenoble (FR)

(73) Assignee: A. RAYMOND ET CIE, Grenoble (FR)

( * ) Notice: Subject to any disclaimer, the term of this patent is extended or adjusted under 35 U.S.C. 154(b) by 0 days.

(21) Appl. No.: 16/368,586

(22) Filed: Mar. 28, 2019

(65) Prior Publication Data

US 2019/0301221 A1 Oct. 3, 2019

(30) Foreign Application Priority Data

Mar. 30, 2018 (FR) ..... 18 52782

(51) Int. Cl.
*E05F 5/02* (2006.01)

(52) U.S. Cl.
CPC ..... *E05F 5/022* (2013.01); *E05Y 2400/82* (2013.01); *E05Y 2600/12* (2013.01); (Continued)

(58) Field of Classification Search
CPC ..... Y10T 16/61; Y10T 16/625; Y10T 16/628; Y10T 16/6285; E05F 5/00; E05F 5/003; E05F 5/006; E05F 5/02; E05F 5/022; E05F 5/06; F16F 1/44; F16F 1/445; F16F 1/3732; F16F 1/3735; B65G 69/001; B65G 2204/4502
See application file for complete search history.

(56) References Cited

U.S. PATENT DOCUMENTS 5,092,550 A * 3/1992 Bettini ..... E05F 5/022 248/188.4
5,735,511 A * 4/1998 Stocker ..... E05F 5/022 248/569

(Continued)

FOREIGN PATENT DOCUMENTS

DE 29716111 U1 1/1998
DE 102011101393 1/2017

(Continued)

OTHER PUBLICATIONS

European Search Report and Opinion for European Application No. 19164433 dated Jul. 16, 2019.

*Primary Examiner* — Chuck Y Mah
(74) *Attorney, Agent, or Firm* — TraskBritt

(57) ABSTRACT

A device for adjusting an elevation of a piece includes a body intended to be secured to a support and comprising a central cylinder provided with an internal thread, and a pin having, over one section of its length, an external thread, and a first end for bearing the piece. The pin and the body are connected to each other through their respective threads, and the pin can, when rotated, move along a longitudinal axis to adjust the elevation of its first end. The body comprises a head with a side window and the pin has, over one section of its length, peripheral notches opposite the side window of the body. The adjustment device also includes a lock placed in the side window of the body, the lock cooperating with the notches of the pin to index the movement thereof.

11 Claims, 2 Drawing Sheets

(52) U.S. Cl.
CPC ..... *E05Y 2600/14* (2013.01); *E05Y 2600/56* (2013.01); *E05Y 2900/536* (2013.01); *E05Y 2900/546* (2013.01); *E05Y 2900/548* (2013.01)

(56) References Cited

U.S. PATENT DOCUMENTS

| | | | | |
|---|---|---|---|---|
| 6,119,306 | A * | 9/2000 | Antonucci | E05F 5/022 16/86 A |
| 6,261,042 | B1 * | 7/2001 | Pratt | F16B 5/10 411/551 |
| 7,114,217 | B2 * | 10/2006 | Matsuzawa | E05F 5/022 16/2.2 |
| 7,356,879 | B2 * | 4/2008 | Dembowsky | F16B 5/0233 16/82 |
| 7,469,445 | B2 * | 12/2008 | Dennis | E05F 5/022 16/82 |
| 8,056,965 | B2 * | 11/2011 | Rosemann | E05F 5/022 16/86 A |
| 8,407,857 | B2 * | 4/2013 | Sugiyama | F16F 1/371 16/86 R |
| 8,616,622 | B2 * | 12/2013 | Davis | B60R 21/34 180/69.2 |
| 9,212,512 | B2 * | 12/2015 | Nakasone | F16F 1/128 |
| 9,580,951 | B2 * | 2/2017 | Duprez | B60J 5/107 |
| 10,150,444 | B1 * | 12/2018 | Schwalm | B60R 21/38 |
| 2002/0003993 | A1 | 1/2002 | Ichimaru | |
| 2004/0025290 | A1 * | 2/2004 | Novarino | E05F 5/022 16/86 A |
| 2016/0303960 | A1 * | 10/2016 | Yon | E05F 5/022 |

FOREIGN PATENT DOCUMENTS

| | | | | |
|---|---|---|---|---|
| EP | 1712434 | A1 * | 10/2006 | E05F 5/022 |
| EP | 2886329 | B1 | 6/2007 | |
| EP | 2840215 | B1 | 1/2017 | |
| FR | 2950379 | B1 | 9/2011 | |
| FR | 3002574 | B1 | 3/2015 | |
| WO | 99/61740 | A1 | 12/1999 | |

* cited by examiner

DEVICE FOR ADJUSTING THE ELEVATION OF A PIECE

PRIORITY CLAIM

This application claims the benefit of the filing date of French Patent Application Serial No. 1852782, filed Mar. 30, 2018, for "DEVICE FOR ADJUSTING THE ELEVATION OF A PIECE."

TECHNICAL FIELD

The present disclosure relates to a device for adjusting the elevation of an end piece. The piece can be a stop, for example for one opening part of a motor vehicle such as a hood, a trunk door, a tailgate, etc. By adjusting the elevation of the piece, the opening part can be precisely positioned in the closed position with the rest of the body.

BACKGROUND

Such a device is known from French Patent No. FR 3002574 B1. It comprises a sleeve intended to be fixed to the vehicle and an adjusting element, bearing a stop, which can slide in the sleeve in order to place the stop at a given height. The device is then locked by imposing a movement on the control element to place retaining lugs in locking grooves and to bring together teeth and grooves arranged respectively on the control elements and on the sleeve to block any movement of the control element and to fix the height of the stop.

The solution proposed in this document effectively allows the stop to be placed at a specific height. However, it does not allow this height to be easily adjusted, especially after the device has been placed in the locking position.

BRIEF SUMMARY

The aim of the present disclosure is to remedy this problem. In particular, the present disclosure aims to allow easy adjustment, for example by indexation, of the elevation of a piece.

In order to achieve, at least in part, this purpose, the subject matter of the present disclosure proposes a device for adjusting the elevation of a piece, the device comprising:

- a body intended to be secured to a support, the body comprising a central cylinder provided with an internal thread;
- a pin having, over one section of its length, an external thread, and a first end for bearing the piece.

The pin and body are connected to each other via their respective threads and the pin can, when rotated, move along a longitudinal axis to adjust the elevation of the first end of the pin.

The body includes a head with a side window and the pin has, over one section of its length, peripheral notches arranged opposite the side window of the body. The adjustment device comprises a lock placed in the side window of the body, the lock cooperating with the notches of the pin to index the movement thereof.

According to other advantageous and non-limiting characteristics of the disclosure, taken either separately or in any technically feasible combination:

- the piece is a stop assembled at the first end of the pin;
- the stop includes a main mark and the head is provided with a plurality of secondary marks;

- the lock is formed by a U-shaped staple comprising two branches each forming or carrying a flexible tab;
- each flexible tab includes a boss that can be received in a notch of the pin;
- the lock includes a movable padlock to block the rotation of the pin
- the padlock has a V shape with two arms, and the arms can be placed on either side of a tooth in the notched area;
- the notched area is provided with six (6) notches.

BRIEF DESCRIPTION OF THE DRAWINGS

Further characteristics and advantages of the disclosure will appear from the following detailed description of embodiments of the invention, made in reference to the accompanying drawings, among which.

DETAILED DESCRIPTION

Figures 1A, 1B:
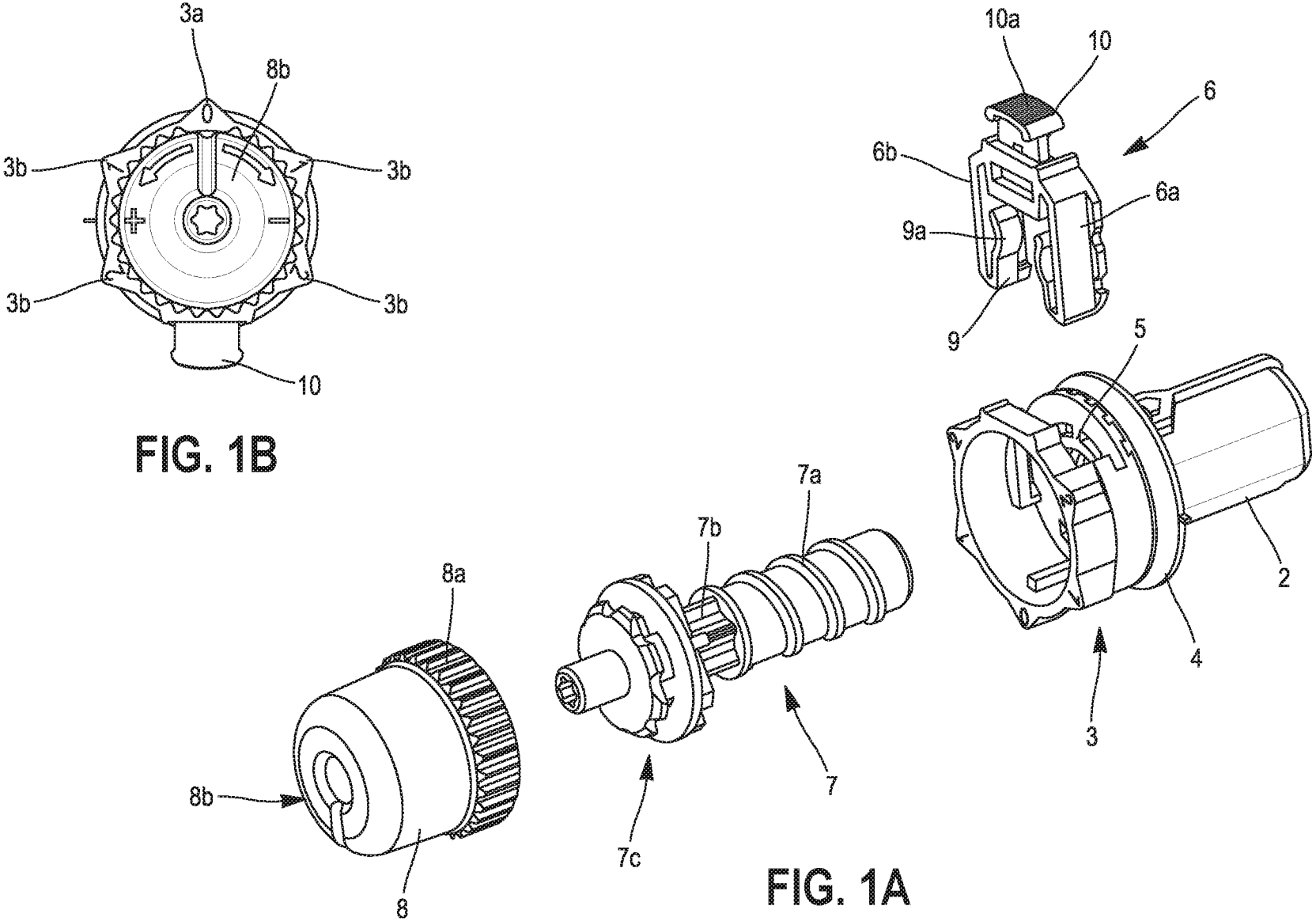
FIG. 1A shows an exploded view of a device according to the present disclosure.
FIG. 1B shows an exploded view of a device according to the present disclosure.

With reference to FIGS. 1A, 1B, 2 and 3, an adjustment device 1 for adjusting the elevation of an end piece 8 comprises a body 2 intended to be rigidly connected to a support. "Elevation" is used in this application to refer to the distance between the end piece 8 and a reference point on the body 2. In the case where the adjustment device 1 constitutes a stop of a motor vehicle opening part, the support may consist of a body element or the vehicle chassis.

Whatever the nature of the support, it is provided with an opening into which the body 2 of the adjustment device 1 can be inserted to be retained. For this purpose, the body 2 may be equipped with retaining devices, such as flexible tabs to allow the body 2 to be elastically interlocked into the support, or locking means to firmly hold the body 2 on the support.

The body 2 extends in a longitudinal direction and defines a central cylinder with an internal thread. At a first end of the cylinder, the body 2 includes a head 3, the transverse dimension of which is larger than those of the cylinder so as to define a shoulder forming a support surface on which the support can be placed in contact. The head 3 has a main opening leading to the inside of the cylinder to screw a pin 7 into it, as will be detailed in further detail below. The other end of the cylinder, opposite the head 3, can be closed.

Figure 2:
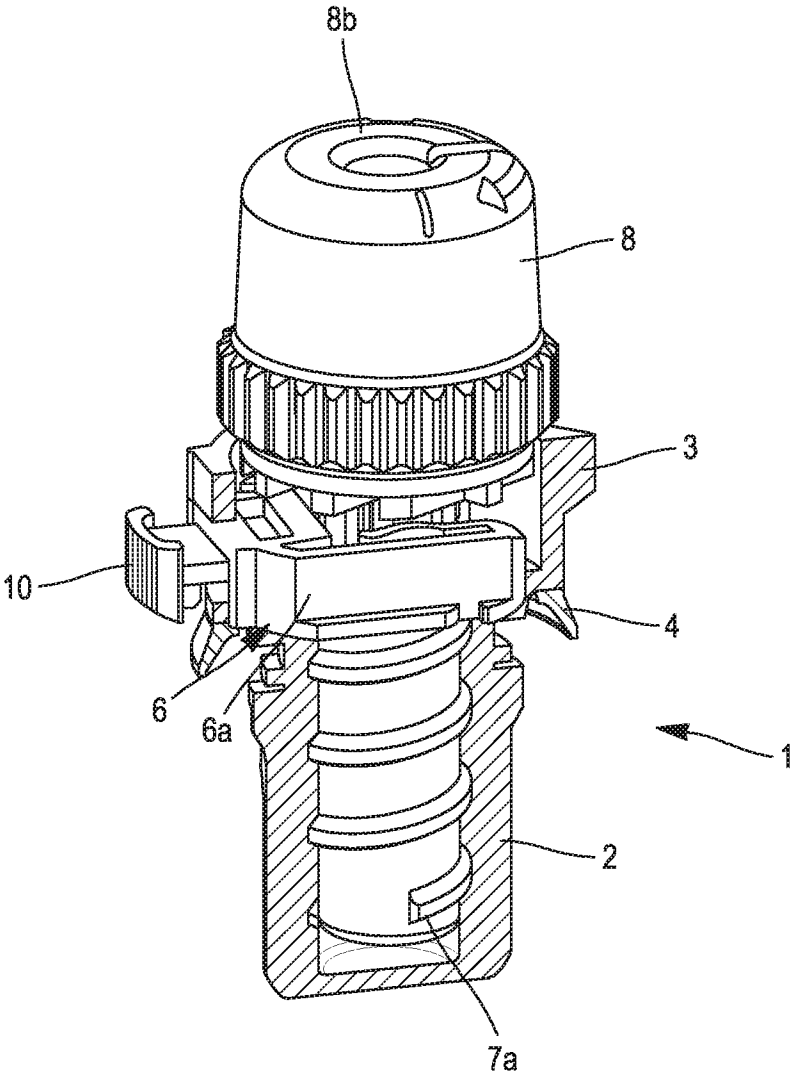
FIG. 2 shows another view of a device according to the present disclosure.

Optionally, the head 3 can be fitted with a sealing washer 4 as shown on the adjustment device 1 in FIGS. 1A and 2, so that the connection between the adjustment device 1 and the support is sealed.

A side window 5 may be provided on the head 3 of the body 2, for receiving a lock 6, as shown in FIG. 1A.

The adjustment device also includes a pin 7. This pin 7 has an external thread 7*a* over one section of its length. On one first end of the pin, an upper connecting area 7*c* is provided to receive, for example by means of a push-fit connection, the end piece 8 of which the elevation is to be adjusted. In the example shown in the figures, this part (end piece 8) consists of a stop made of an elastomeric material.

The elastomeric stop of end piece 8 has a peripheral notched area 8*a* that facilitates the gripping thereof, in particular, for the rotational movement of the pin 7.

The dimensions of the pin 7 and of the cylinder of the body 2 are chosen so that the two parts can be assembled together by screwing same together using their respective threads. The pin 7, when driven in rotation, can then move in a longitudinal direction, which enables the elevation of the end piece 8, in this case, the elastomeric stop, to be adjusted.

As is well known per se, the pitch of the internal thread of the cylinder and external thread of the pin 7 is chosen to determine the variation in the elevation of the end piece 8 for each complete rotation of the pin 7 in the body 2. For example, by choosing a 6 mm pitch, the elevation of the end piece 8 will be varied by + or −1 mm from a nominal elevation, by imposing a rotation of one sixth of a turn of the pin 7 in either direction.

To facilitate the use of the adjustment device 1, a first mark 8*b* may be formed on the elastomeric stop of end piece 8, and a set of secondary marks 3*a*, 3*b* may be formed on the head 3 of the body 2. A secondary reference mark 3*a* can form a reference with which the first mark 8*b* is aligned in the adjustment configuration of the adjustment device 1. The secondary marks are separated from each other by a constant angular offset, in this case 60°. By rotating the pin 7, the first mark 8*b* can be positioned opposite one of the secondary marks 3*a*, 3*b*, and the elevation adjustment of the end piece can be precisely controlled.

Figure 3:
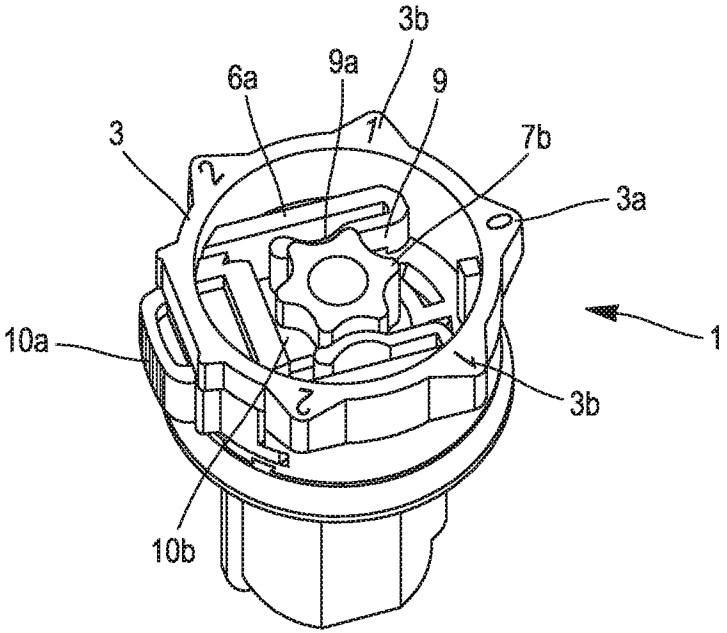
FIG. 3 shows a section at the notched area of the pin of a device according to the present disclosure.

Returning to the general description of the adjustment device 1, the pin 7 also includes notches 7*b* in a section of its length. As can be seen in FIG. 3, these notches 7*b* can be defined by the spaces between the teeth arranged peripherally on the pin 7 like a gear. The adjustment device 1 shown in the figures includes six of these notches, uniformly distributed over the peripheral contour of the pin 7.

When the pin 7 is properly assembled, in the adjustment position, to the body 2, screwed into this body 2, the side window 5 fitted on the head 3 of the body 2 opens in the notched section that includes the notches 7*b* of the pin 7.

The lock 6 can then be inserted into the side window 5 of the head 3. This lock 6 is configured to cooperate with the notches 7*b* of the pin 7 and index the rotational movement of the pin 7, thus indexing the elevation of the end piece.

By coordinating the arrangement of the notches 7*b* and the marks 8*b*, 3*a*, 3*b*, there is a mechanism making it possible to easily adjust the elevation of the end piece 8, here by a sixth of a turn rotation of the pin 7. Each quarter turn of rotation, depending on the selected thread pitch, corresponds to a specific variation in the elevation of the end piece, for example by 1 mm or 2 mm.

The lock 6 can take the form of a U-shaped staple, and therefore has two branches 6*a*, 6*b*. Each branch 6*a*, 6*b* forms or carries a flexible tab 9, here connected to the free end of the branch 6*a*, 6*b* that carries the flexible tab 9, respectively. Each flexible tab 9 includes a boss 9*a*. When the lock 6 is inserted into the side window 5 of the adjustment device 1, in the adjustment position, the branches 6*a*, 6*b* are arranged on either side of the notched section that includes the notches 7*b* of the pin 7. When the pin 7 is rotated, the teeth of the notched section that includes the notches 7*b* come into contact with the flexible tabs 9, and, in particular, with the boss 9*a* placed on each of these flexible tabs 9, to cause them to bend and thus allow the pin 7 to rotate. A stationary position of the pin 7 is obtained when the bosses 9*a* of the flexible tabs 9 are positioned in some of the notches 7*b* of the pin 7.

The rotational displacement, and therefore the elevation displacement, of the pin 7 can thus be indexed. The rotational force required to move the flexible tab 9 from one notch 7*b* to the other is determined by the rigidity of the flexible tabs 9 of the lock 6.

In an advantageous alternative solution of the adjustment device 1, and in order to securely block the elevation of the end piece 8, a locking device for the lock 6 can be provided.

For this purpose, the lock 6 carries a movable padlock 10 that can move transversely in the lock 6 by exerting an effort on a push zone 10*a* of the padlock 10. The padlock 10 can selectively take an open position in which the pin is free to be moved in rotation in the body 2, indexed by the notches 7*b* cooperating with the flexible tabs 9, as described above. The padlock 10 can also take a closed position when it has been moved transversely to enter the lock 6 and block the rotation of the pin 7. The padlock 10 may have a V-shape 10*b* at its end intended to penetrate between the two branches 6*a*, 6*b* of the lock 6. The arms of the V-shape 10*b* are designed to cooperate with notches 7*b* of the pin 7 in order to prevent the rotation thereof, the two arms of the V being placed on either side of a tooth of the area of notches 7*b* of the pin 7.

In this way, any rotational movement of the pin 7 and the disruption of the selected elevation of the end piece 8, which could be caused, for example, by vibrations of the support on which the adjustment device 1 is positioned, are prevented.

Using the adjustment device 1 is particularly simple. It is delivered in the adjustment position, i.e., with the pin screwed into the body 2 so that the notches 7*b* are positioned opposite the side window 5 of the body 2. The lock 6 is inserted into the side window 5 so that the bosses 9*a* of the flexible tabs are respectively received in a notch 7*b* of the pin 7. The padlock is in the open position. Advantageously, the first mark 8*b* on the end piece 8 is opposite the reference mark 3*a* on the head 3 of the body 2.

The adjustment device 1 is then positioned on the support. The elevation of the end piece 8, here, the elastomeric stop, can then be adjusted by grasping this piece at the notched area 8*a* thereof and by rotating the pin 7 to place the first main mark of notched area 8*a* on one of the secondary marks 3*b*. The sixth of a turn movement is indexed by the cooperation of the notches 7*b* with the bosses 9*a* of the flexible tabs 9.

When the end piece 8 is positioned at a selected elevation, the adjustment device 1 can be locked by exerting a force on the push zone 10*a* of the padlock 10, which tends to place each of the arms of V-shape 10*b* of the padlock 10 on either side of a tooth in the zone of notches 7*b* of the pin 7. This prevents any unwanted rotational movement of the pin 7.

The parts of the adjustment device 1 as described herein may be made of a plastic material, and the device manufactured by, for example, an injection molding process or an additive manufacturing process.

Of course, the invention is not limited to the described embodiments and alternative solutions can be used without departing from the scope of the invention, as defined in the claims.

What is claimed is:

1. A device for adjusting an elevation of a piece, the device comprising:

a body intended to be secured to a support, the body comprising a central cylinder having an internal thread and a head having a side window;

a pin having an external thread, a first end for bearing the piece, and a notched area including peripheral notches aligned with the side window of the body, the pin and the body being connected to one other via their respective threads; and a lock positioned in the side window of the body to cooperate with the peripheral notches of the pin and index movement thereof;

wherein the pin, when rotated, moves along a longitudinal axis to adjust the elevation of the first end of the pin relative to the body.

2. The device of claim 1, further comprising the piece, and wherein the piece is a stop carried by the first end of the pin.

3. The device of claim 2, wherein the stop comprises a main mark and the head comprises with a plurality of secondary marks.

4. The device of claim 3, wherein the lock comprises a U-shaped member having two branches each forming or carrying a flexible tab.

5. The device of claim 4, wherein each flexible tab includes a boss that can be positioned in a respective notch of the peripheral notches of the pin.

6. The device of claim 5, wherein the lock includes a movable padlock to block rotation of the pin.

7. The device of claim 6, wherein the movable padlock has a V shape formed by two arms, the arms being able to be placed on either side of a tooth of a notched area.

8. The device of claim 7, wherein the notched area is provided with 6 notches.

9. The device of claim 1, wherein the lock comprises a U-shaped member having two branches each forming or carrying a flexible tab.

10. The device of claim 9, wherein each flexible tab includes a boss that can be positioned in a respective notch of the peripheral notches of the pin.

11. The device of claim 1, wherein the lock includes a movable padlock to block rotation of the pin.

* * * * *